US010265994B2

(12) United States Patent
Kerkar et al.

(10) Patent No.: US 10,265,994 B2
(45) Date of Patent: Apr. 23, 2019

(54) BANKNOTES HAVING INTERRELATED FEATURES

(71) Applicant: SICPA HOLDING SA, Prilly (CH)

(72) Inventors: Brahim Kerkar, Pully (CH); Philippe Amon, Aubonne (CH)

(73) Assignee: SICPA HOLDING SA, Prilly (CH)

( * ) Notice: Subject to any disclaimer, the term of this patent is extended or adjusted under 35 U.S.C. 154(b) by 60 days.

(21) Appl. No.: 15/510,116

(22) PCT Filed: Sep. 1, 2015

(86) PCT No.: PCT/EP2015/069919
§ 371 (c)(1),
(2) Date: Mar. 9, 2017

(87) PCT Pub. No.: WO2016/037895
PCT Pub. Date: Mar. 17, 2016

(65) Prior Publication Data

US 2017/0253069 A1 Sep. 7, 2017

(30) Foreign Application Priority Data

Sep. 9, 2014 (EP) ..... 14184057

(51) Int. Cl.

| | |
|---|---|
| ***B42D 25/305*** | (2014.01) |
| ***G07D 7/20*** | (2016.01) |
| ***G07D 7/00*** | (2016.01) |
| ***G07D 7/01*** | (2016.01) |
| ***B42D 25/378*** | (2014.01) |
| ***B42D 25/29*** | (2014.01) |

(52) U.S. Cl.
CPC ..... *B42D 25/305* (2014.10); *B42D 25/29* (2014.10); *B42D 25/378* (2014.10); *G07D 7/003* (2017.05); *G07D 7/01* (2017.05); *G07D 7/20* (2013.01)

(58) Field of Classification Search
CPC .... B42D 25/305; B42D 25/378; B42D 25/29; G07D 7/20; G07D 7/003; G07D 7/01
USPC ..... 283/67, 70, 72, 74, 83, 94, 98, 901
See application file for complete search history.

(56) References Cited

U.S. PATENT DOCUMENTS

| | | | | |
|---|---|---|---|---|
| 6,565,770 | B1 | 5/2003 | Mayer et al. | |
| 2005/0150740 | A1* | 7/2005 | Finkenzeller | G07F 1/06 194/207 |
| 2010/0200649 | A1 | 8/2010 | Callegari et al. | |

(Continued)

FOREIGN PATENT DOCUMENTS

| | | |
|---|---|---|
| CN | 102529493 | 7/2012 |
| CN | 102812476 | 12/2012 |

(Continued)

OTHER PUBLICATIONS

"Organic thin-film transistors on plastic substrates," by Lim et al., Materials Science and Engineering: B, vol. 121, Issue 3, Aug. 15, 2005, pp. 211-215.

(Continued)

*Primary Examiner* — Justin V Lewis
(74) *Attorney, Agent, or Firm* — Muncy, Geissler, Olds & Lowe, P.C.

(57) ABSTRACT

A banknote having one or more security features and at least one flexible printed electronic (FPE) element embedded in the banknote. At least one of the security features and at least one FPE element have an interrelationship with each other.

17 Claims, 4 Drawing Sheets

(56) References Cited

U.S. PATENT DOCUMENTS

| | | | |
|---|---|---|---|
| 2010/0307376 | A1 | 12/2010 | Aboutanos et al. |
| 2011/0293899 | A1 | 12/2011 | Tiller et al. |
| 2013/0256415 | A1 | 10/2013 | Callegari et al. |

FOREIGN PATENT DOCUMENTS

| | | |
|---|---|---|
| CN | 102991185 | 3/2013 |
| CN | 103890786 | 6/2014 |
| EP | 1988514 | 11/2008 |
| WO | 2007060133 | 5/2007 |
| WO | 2008000755 | 1/2008 |
| WO | 2008033059 | 3/2008 |
| WO | 2008092522 | 8/2008 |
| WO | 2008128714 | 10/2008 |
| WO | 2010121362 | 10/2010 |
| WO | 2013028930 | 2/2013 |
| WO | 2013083253 | 6/2013 |

OTHER PUBLICATIONS

International Search Report and Written Opinion issued with respect to application No. PCT/EP2015/069919.

Chinese office action and Search Report in counterpart Chinese Application No. 201580048616.9 dated Feb. 26, 2018 (and English language translation of Office Action).

* cited by examiner

BANKNOTES HAVING INTERRELATED FEATURES

FIELD OF THE INVENTION

The present invention relates to a more secure banknote, and in particular, a banknote having interrelated features.

BACKGROUND OF THE INVENTION

With the constantly improving quality of color photocopies and printings and in an attempt to protect security documents, in particular long-lived security documents, e.g. banknotes, requiring high resistance against counterfeiting or illegal reproduction, it has been the conventional practice to incorporate various security means in these documents. In particular, the security means are typically chosen from different technology fields, manufactured by different suppliers, and embodied in different constituting parts of the security document. To break the security document, the counterfeiter would need to obtain all of the implied materials and to get access to all of the required processing technology, which is a hardly achievable task. Typical examples of security means include security threads, windows, fibers, planchettes, foils, decals, holograms, watermarks, security inks comprising optically variable pigments, magnetic or magnetizable pigments, interference-coated particles, thermochromic pigments, photochromic pigments, luminescent, infrared-absorbing, ultraviolet-absorbing compounds.

Some of the ill-effects that counterfeit money has on society include a decrease of the value of real money; an increase in prices (inflation) due to more money getting circulated in the economy—an unauthorized artificial increase in the money supply; a decrease in the acceptability of paper money (payees may demand electronic transfers of real money or payment in another currency (or even payment in a precious metal such as gold)); and losses, when traders are not reimbursed for counterfeit money detected by banks, even if it is confiscated. Furthermore, a major ill-effect resides in reduction in trust of the currency and the government.

Accordingly, a need exists for a banknote with improved security features.

SUMMARY OF THE INVENTION

Embodiments of the present disclosure are directed to a banknote comprising one or more security features, and at least one flexible printed electronic (FPE) element embedded in the banknote. At least one of the one or more security features and at least one FPE element have an interrelationship with each other.

In embodiments, the at least one FPE element is a passive electronic element. In some embodiments, the at least one FPE element is an active electronic element.

In further embodiments, the banknote further comprises an encrypted signature stored in the memory of the at least one FPE when the banknote is produced, said FPE being readable when properly decrypted by a specific ATM or Reader.

In yet additional embodiments, the interrelationship is verifiable to authenticate the banknote.

In some embodiments, the interrelationship comprises one of a factor and a multiple between a property of a first of the one or more security feature and a property of a second of one or more of security features.

In embodiments, the interrelationship provides enhanced security capabilities for the banknote.

In embodiments, the one or more security features described herein are selected from the group consisting of serial numbers; printed patterns, designs or codes made of a security ink; intaglio printed patterns or designs; security threads or stripes; windows; fibers; planchettes; foils; decals; holograms; microprintings; 3-D security ribbons; and watermarks.

In some embodiments, the FPE element comprises one or more elements selected from the group consisting of RFIDs, sensors, transistors, flexible displays, flexible batteries, electronic chips, memories, flexible near field communication (NFC) devices, and flexible communication devices.

In further embodiments, at least one FPE comprises a sensor or a transistor having analysis capabilities. In yet additional embodiments, the sensor or transistor is operable to detect at least one of a capacitance, an impedance, and a pH value of the banknote.

In further embodiments, the at least one FPE element comprises a plurality of printed layers, wherein at least one of the printed layers comprises one or more marker materials or taggants.

In yet additional embodiments, the banknote further comprises an organic thin film transistor having at least one plastic layer and at least one organic layer, wherein the one or more security features comprises at least one of inorganic and fluorescent molecules within the organic thin film transistor. In embodiments, the inorganic and fluorescent molecules are selected from molecules selected from UV, NIR, IR range of the electromagnetic spectrum with one or more predetermined spectral properties. Preferably, at least one of said one or more predetermined properties are interrelated with one or more other security features. More preferably, said interrelation with one or more other security features comprises a lamba max ($\lambda_{max}$) of the luminescence as an integer multiple or factor of a $\lambda_{max}$.

In yet additional embodiments, the FPE comprises at least two FPEs, and further comprising an FPE interrelation between a plurality of the at least two FPEs.

In some embodiments, each FPE of said at least two FPEs contains one or more security features comprising a chemical key represented with a set of molecules having different absorption or emission spectra.

In some embodiments, the banknote further comprises "n" FPEs and "m" luminescent compounds, providing n*m potential combinations of secure FPE dispatched in each banknote. Preferably, said each banknote is traceable based on the n*m potential combinations of secure FPEs.

In yet additional embodiments, the FPE interrelation comprises a spatial relationship and/or a relative size relationship between one or more security features and/or a plurality of the at least two FPEs. Preferably, said spatial relationship comprises an FPE transistor being arranged at a distance of 3 cm from a magnetic security thread or stripe or a colorshift effect pattern.

In some embodiments, the FPE interrelation is itself interrelated with at least one of the plurality of security features.

In further embodiments, the FPE interrelation is itself interrelated with the interrelationship between the at least one of the security features and at least one FPE.

Embodiments of the present disclosure are directed to a banknote comprising one or more security features, wherein at least two of the one or more security features have an interrelationship with each other.

Embodiments of the present disclosure are also directed to a method of making a banknote comprising providing a banknote with one or more security features, and including at least one flexible printed electronic (FPE) element in the banknote, wherein at least one of the one or more security features and at least one FPE element have an interrelationship with each other. Preferably, said interrelationship is verifiable to authenticate the banknote.

In some embodiments, the at least one FPE element is embedded in the banknote.

Embodiments of the present disclosure are also directed to a method of authenticating a banknote comprising detecting one or more security features of the banknote, detecting at least one flexible printed electronic (FPE) element in the banknote, wherein at least one of the security features and at least one FPE element have an interrelationship with each other, and verifying a proper interrelationship to authenticate the banknote.

Further embodiments of the present disclosure are directed to an FPE comprising a plurality of layers, wherein at least one layer includes a security feature comprising a chemical key represented with a set of molecules having different absorption or emission spectra.

BRIEF DESCRIPTION OF DRAWINGS

Embodiments of the present invention are further described in the detailed description which follows, in reference to the noted plurality of drawings, by way of non-limiting examples of embodiments of the present invention, in which like characters represent like elements throughout the several views of the drawings.

DETAILED DESCRIPTION

Figure 1:
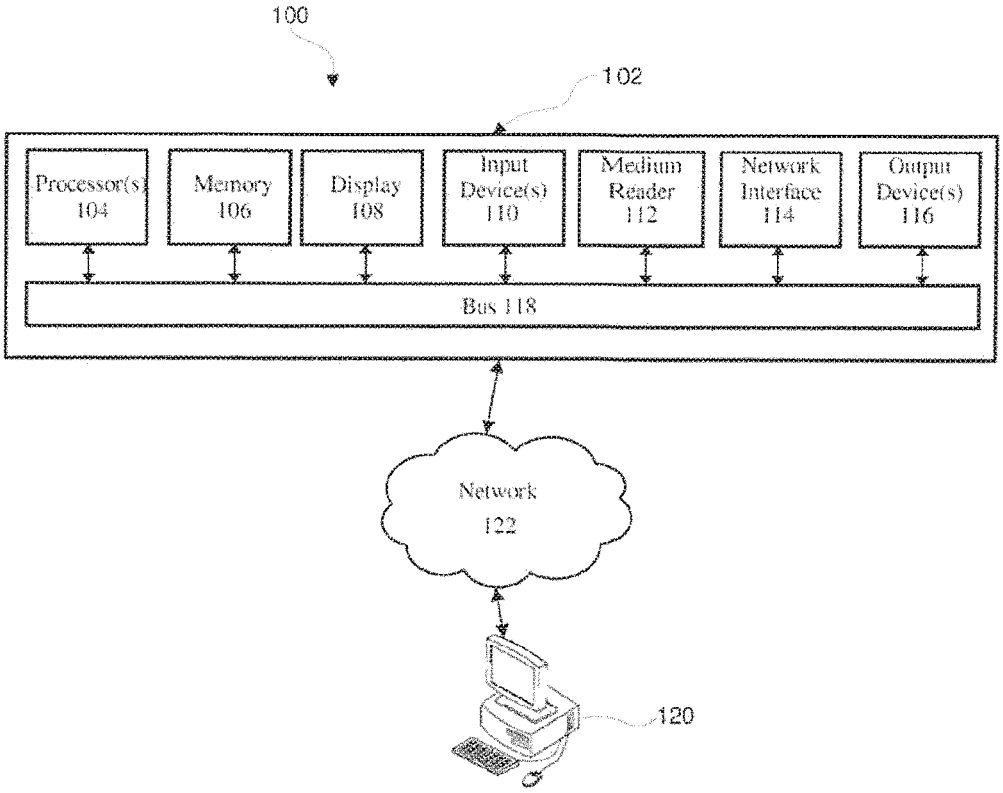
FIG. 1 schematically depicts an exemplary system for use in accordance with embodiments described herein.

The present disclosure, through one or more of its various aspects, embodiments and/or specific features or sub-components, is thus intended to bring out one or more of the advantages as specifically noted below.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice. As should be understood, at least some of the exemplary schematic representations are not necessarily drawn to scale in order to more clearly illustrate aspects of the present invention.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiments were chosen and described in order to best explain the principles of the present invention and its practical application, to thereby enable others skilled in the art to best utilize the present invention and various embodiments with various modifications as are suited to the particular use contemplated.

As used herein, the singular forms "a", "an", and "the" include the plural reference unless the context clearly dictates otherwise. Except where otherwise indicated, all numbers expressing quantities, and so forth used in the specification and claims are to be understood as being modified in all instances by the term "about." Accordingly, unless indicated to the contrary, the numerical parameters set forth in the specification and claims are approximations that may vary depending upon the desired properties sought to be obtained by the present invention. At the very least, and not to be considered as an attempt to limit the application of the doctrine of equivalents to the scope of the claims, each numerical parameter should be construed in light of the number of significant digits and ordinary rounding conventions.

The various embodiments disclosed herein can be used separately and in various combinations unless specifically stated to the contrary.

Flexible printed electronic (FPE) elements (also referred to FPE herein) include printed electronics or electrical devices on various substrates formed with printing methods. FPEs are thin, light-weight, and flexible. Printing typically uses common printing equipment suitable for defining patterns or designs on material, such as screen printing, flexography, gravure, offset lithography, and/or inkjet printing. Electrically functional electronic or optical inks are deposited on the substrate, creating active or passive devices, such as thin film transistors or resistors, for example. A plurality of ink layers are applied one atop another to form the FPE. Printing on flexible substrates allows electronics to be placed on curved (or curvable) surfaces, for example, within currency (e.g., a banknote). In embodiments, the FPE provides a flexible substrate, with multicomponent integration, and embedded functionalities.

An FPE may be formed using one or more electronic inks (e.g., an ink for semiconductor properties of the FPE, an ink for conductor properties of the FPE conductor, and an ink for insulator properties of the FPE) to print conductors and insulators, etc. These layers of ink may be printed, for example, using a gravure printing (e.g., registered high precision gravure printing, for example using opto-mechanical alignment) to form a multilayer stack on flexible substrate. These layers of ink may also be printed by inkjet to form a multilayer stack with precision alignment. A thermal sintering process is typically used to functionalize the inks, e.g., functionalize the film, remove solvent, and enable sintering of printed layer.

As described in "Organic thin-film transistors on plastic substrates," by Lim et al., Materials Science and Engineering: B, Volume 121, Issue 3, 15 Aug. 2005, Pages 211-215, the content of which is expressly incorporated by reference herein in its entirety, organic thin-film transistors (OTFTs) were fabricated on polyethersulfone (PES) and silicon (Si) substrates with top-contact geometry. Several kinds of metals with different work functions were used for source and drain electrodes, and optimum fabrication conditions were found. Photo cross-linkable polymeric gate dielectrics and thermal silicone oxide ($SiO_2$) were used for the plastic and Si OTFTs, respectively.

While attempts have been made to integrate an FPE, e.g., a printed circuit, a display, or one or more electronic chips in a banknote, these elements are mostly passive elements and are without any power supply. For example, RFIDs only support storing of data, and are interrogatable to obtain the stored data inside. With attempted approaches, displays (e.g., screens) display common information and/or information related to the use of the banknote. With existing approaches, the printed electronic elements are only providing their own respective functions (e.g., in a stand-alone manner).

In accordance with aspects of the disclosure, the at least one FPE element, for example, in addition to its/their individual function, is/are correlated to one or more other security features of the banknote and/or acts/act simultaneously as added security features to the existing banknote security features. FPEs are used to be compatible with the nature and thickness of a banknote, and the interrelation of the FPE with the one or more security features provides a high level of security for the banknote. In accordance with aspects of the disclosure, the banknote provides value of exchange with additional capabilities in the form of one or more secure FPEs which are inserted in a specific manner in/on a banknote with the existing security features in an interrelated manner.

Embodiments of the present disclosure are directed to a banknote comprising one or more security features and at least one flexible printed electronic (FPE) element wherein at least one of the one or more security features and at least one FPE element have an interrelationship (e.g., are linked) with each other. Further embodiments of the present disclosure are directed to a method of making a banknote comprising including at least one flexible printed electronic (FPE) element in a banknote comprising one or more security features, wherein at least one of the one or more security features and at least one FPE element have an interrelationship with each other. By implementing aspects of the disclosure, a banknote with extended capabilities is provided. In accordance with aspects of the disclosure, the interrelationship between the FPE and the security feature(s) is verifiable to authenticate the banknote.

Additional embodiments of the present disclosure are directed to a method of authenticating a banknote comprising detecting one or more security features of the banknote, detecting at least one flexible printed electronic (FPE) element in the banknote, wherein at least one of the one or more security features and at least one FPE element have an interrelationship with each other. The method further includes verifying a proper interrelationship to authenticate the banknote.

In some embodiments, the flexible printed electronics may be organic thin film transistors (OTFTs) or organic electronics, which can be produced by ink printing techniques. In some embodiments, the FPE element comprises one or more elements selected from the group consisting of RFIDs, sensors; transistors, flexible displays, flexible batteries, electronic chips, memories, flexible near field communication (NFC) devices, and flexible communication devices. For example, the printed OTFT can be used for displays (e.g., OLED thin display), intelligent tags, large area sensors, smart labels, flexible memory, and/or integrated circuits. In embodiments, at least one of the FPE elements is a passive electronic element. In further embodiments, at least one of the FPE elements is an active electronic element.

In some embodiments, the at least one FPE element is embedded in the banknote. In embodiments, the at least one FPE may be arranged within the substrate (such as for example paper) or above the substrate (e.g., on one of the banknote's faces), and/or inserted in a transparent window of the banknote. In further embodiments, the at least one FPE may be located in a security thread or stripe of the banknote. In embodiments, FPEs may be located on different precise places in the banknote (e.g., one in the corner, and the other in the middle, etc.).

Figure 2:
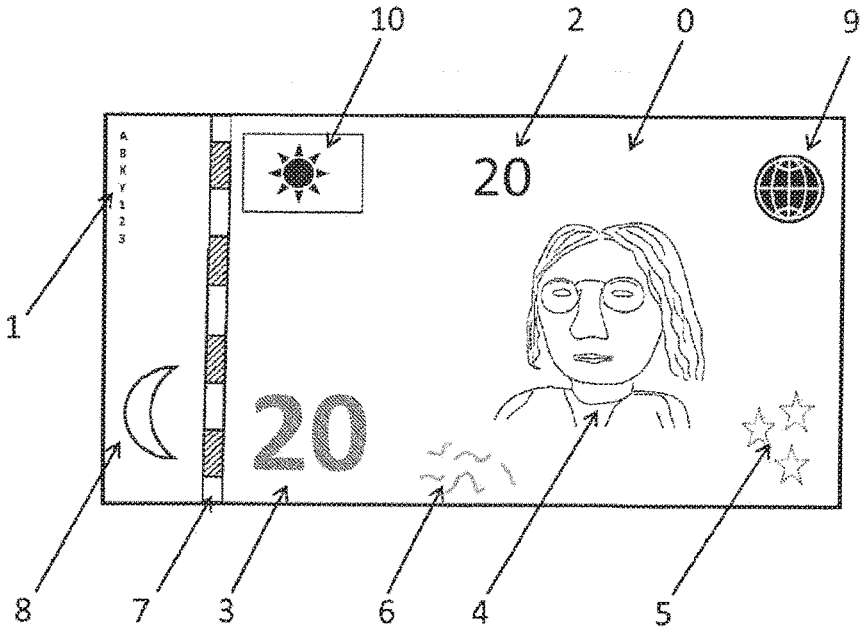
FIG. 2 illustrates an exemplary banknote comprising security features.

Banknotes include one or more security features in an effort to protect the authenticity of the banknote. Security features, e.g. for security documents, can generally be classified into "covert" security features on the one hand, and "overt" security features on the other hand. The protection provided by covert security features relies on the concept that such features are difficult to detect, typically requiring specialized equipment or instrument and knowledge for detection, whereas "overt" security features rely on the concept of being easily detectable with the unaided human senses, e.g. such features may be visible and/or detectable via the tactile senses while still being difficult to produce and/or to copy. Typical examples of security features for the banknote include without limitation serial numbers; printed patterns, designs or codes made of a security ink (e.g. magnetic inks, luminescent inks, magnetic ink, colorshifting inks, IR absorbing inks, UV absorbing inks, and taggant inks); intaglio printed patterns or designs; security threads or stripes; windows; fibers; planchettes; foils; decals; holograms; microprintings; 3-D security ribbons; and watermarks. Said one or more security features may be comprised in the banknote itself, i.e. embedded within the substrate of the banknote or may be present on the surface of the banknote. FIG. 2 illustrates a banknote comprising a substrate (0), a flag (10) and security features being a serial number (1), value numbers (2; 3) (wherein one of said value number is made of a colorshifting ink), an intaglio printed design (4), patterns made of a luminescent ink (5), luminescent fibers (6) incorporated in the substrate (0); a security thread (7), a transparent window (8) and a hologram (9).

A currency detector or currency validator is a device that determines whether banknotes or coins are genuine or counterfeit. These devices are used in many automated machines found in retail kiosks, self-checkout machines, gaming machines, transportation parking machines, automatic fare collection machines, and vending machines. The validating process may involve examining the banknote that has been inserted, and by using various tests, determining if the banknote is counterfeit. Since the parameters are different for each banknote, these detectors may be programmed for each item that they are to accept.

Optical sensing with a small light detector called a photocell or a miniature digital camera is one of the main techniques that vending machines use. The optical sensors can look for these different patterns to determine what sort of banknote is being inserted. For example, dollar banknotes exhibit fluorescence when they are illuminated by ultraviolet light. Some machines shine an ultraviolet light on the banknote and measure the emission to help determine just what they are looking at.

Magnetic inks are commonly printed to produce security patterns, designs or codes for the protection of banknotes against counterfeiting or illegal reproduction. Suitable magnetic inks for banknotes typically comprise one or more materials selected from the group consisting of nickel, cobalt, iron, oxides thereof, alloys thereof and combinations thereof. Accordingly, magnetic sensing may also be used to validate a banknote. In embodiments, banknotes are passed over a permanent magnet array and magnetized along their direction of travel. A magnetic sensor located several inches away with its sensitive axis parallel to the direction of travel can detect the remnant field of the ink particles.

Additionally, physical attributes of the banknotes, including without limitation the thickness and dimensions of a banknote, may be tested to ensure they are correct. As the banknote passes between the rollers, the voltages vary according to its thickness.

Banknotes may include a security thread or stripe, said security thread or stripe may be at least partially embedded in the banknote or may be mounted on the surface of the banknote. Security threads or stripes carry particular security elements, serving for the public- and/or machine-authentication of the banknotes. Typical examples of additional security features for security threads or stripes include optically variable materials, luminescent materials, IR absorbing materials and magnetic materials.

In some embodiments, the interrelationship between the at least one FPE and the one or more security features comprises either a factor or a multiple between a property of a security feature and a property of the FPE. The FPE element comprises one or more printed layers, wherein at least one of the printed layers comprises one or more marker materials or taggants. With an exemplary and non-limiting embodiment, an FPE (e.g., an OTFT) may be functionalized with one or more security luminescent compounds (e.g., one or more security luminescent compounds are applied to and/or integrated, for example, into portions of the FPE). In embodiments, the one or more printed layers may include a marker composition (also referred in the art to taggant composition), a luminescent ink, a magnetic ink, etc. In yet additional embodiments, the banknote may include an organic thin film transistor having at least one plastic layer and at least one organic layer, wherein the one or more security features comprises at least one of inorganic and fluorescent molecules within the organic thin film transistor. The luminescent molecules may be selected from molecules selected from UV, NIR, IR range of the electromagnetic spectrum with one or more predetermined spectral properties.

The security luminescent compounds are applied and/or integrated in such a location and/or manner so as to not affect the intended behavior of the OTFT. In accordance with aspects of embodiments of the disclosure, the security luminescent compounds of the FPE are interrelated with one or more other security features present in or on the banknote (e.g., a security ink of the banknote or a security thread or stripe embedded or mounted to a banknote). With an exemplary and non-limiting embodiment, the FPE comprises a fluorescent composition with a $A_{max}$ that is correlated with a $A_{max}$ of a luminescent element (for example a luminescent printed pattern, a luminescent security thread or stripe embedded or mounted to the banknote, or a luminescent fiber incorporated in the substrate of the banknote) by a relation of multiple or integer. In some embodiments, at least one of the one or more predetermined spectral properties of the molecules are interrelated with one or more other security features of the banknote. For example, the interrelation may comprises a $A_{max}$ of the luminescence as an integer multiple or factor of a $A_{max}$ of another security features of the banknote. In accordance with aspects of embodiments of the disclosure, the interrelationship provides enhanced security capabilities for the banknote.

In embodiments, the flexible structure embeds security features therein. In some embodiments, as noted above, for example, the flexible plastic sheet supporting the printed elements of the FPE may also support a marking, and may be functionalized by adding a marking. Additionally, after the FPE is formed, a neutral varnish (e.g., transparent) that maintains the FPE functionality and capabilities, may be functionalized by adding a marking protection layer thereto.

In further embodiments, at least one FPE comprises a sensor or a transistor having analysis capabilities operable to detect at least one of a capacitance, an impedance, and a pH value of the banknote. The FPE (or an additional FPE) has data storage capabilities in order to store at least one of the capacitance, the impedance, and the pH value of the banknote (for example, previously measured). In accordance with aspects of embodiments of the disclosure, the FPE is interrelated with the properties (e.g., capacitance, impedance, and/or pH value) of the banknote.

With embodiments having active FPEs, the active FPEs can also contain (e.g., in an encrypted manner) one or more, or all the physical attributes of the banknote (e.g., including attributes of the security features) in a memory. For example, when the banknote was validly produced, all the features inside (the banknote's fingerprint, in a way) will be stored or written in the FPE of the banknote and secured. Then if part of substrate is destroyed, the remaining information or its fingerprint identity stored will attest to the banknote's value and will keep its value of exchange.

In yet additional embodiments, the at least one FPE comprises at least two FPEs, and the banknote further comprises an FPE interrelation between a plurality of the at least two FPEs. For example, each FPE contains one or more security features comprising a chemical key represented with a set of molecules having different absorption or emission spectra. With an exemplary embodiment, the banknote further comprises "n" FPEs and "m" luminescent compounds, providing n*m potential combinations of secure FPE dispatched in each banknote. In accordance with aspects of embodiments of the disclosure, each banknote is traceable based on the n*m potential combinations of secure FPEs. For example, having five embedded flexible printed electronic (FPE) elements, each supporting at least two different security luminescent compounds, by mixing different FPEs with different luminescence (all FPEs may be connected together, assuming the same function), a combinatorial identity (e.g., unique identity) may be created for the banknote.

In yet additional embodiments, the FPE interrelation comprises a spatial relationship and/or a relative size relationship between the FPE and a security feature, and/or between the plurality of the at least two FPEs. For example, the spatial relationship may include an FPE transistor being arranged at a distance of 3 cm from a magnetic security thread or stripe or a colorshift effect pattern.

For example, a banknote includes existing security features. The FPE comprises one or more security features, wherein at least one of them is an LCP (liquid crystal polymer) coating or a CLCP (cholesteric liquid crystal polymer) coating on a plastic sheet having a maximum of reflection band in the invisible range at 540 nm or having an inorganic chelates dispatched on (or in) the plastic sheet of the FPE, for example, having a strong red emission with a maximum at 617 nm (which can be observed under 254 nm excitation).

With reference to FIG. 2 which represents a banknote having a numeral "20" (e.g., (2) and (3)) close to a flag (10), the invention contemplates that the distance between the flag (10) and the numeral "20" (e.g., (2) or (3), respectively) is chosen so as to be (e.g., in cm) a multiple of the wave length of the security feature of the FPE with a LCP coating or a CLCP coating (e.g., 540 nm or 617 nm, amongst other contemplated wavelengths). With further contemplated embodiments, a distance between the flag (10) and the numeral "20" (2), is a multiple of the distance, and thus, also interrelated with the security feature of the FPE with a LCP or CLCP coating. With further contemplated embodiments, the colorshift in the numeral "20" may have a colorshifting effect (e.g. a color change from green to blue while tilting the banknote) having a reflection band of 360 nm, which is, for example, 1.5 times the reflection band of, e.g., the functionalized plastic sheet or any one of the layer of the FPE or OTFT.

In further embodiments, the FPE interrelation (between, e.g., two FPEs) itself may also be interrelated with at least one of the one or more security features. With an exemplary and non-limiting embodiment, a difference in luminesce decay between luminescent materials respectively contained in the two FPEs may also represent a relative location (e.g., from a fixed location on the banknote) of a security feature of the banknote. In some embodiments, the FPE interrelation is itself interrelated with the interrelationship between the one or more of the security features and another FPE. With an exemplary and non-limiting embodiment, a difference in luminesce decay between luminescent materials respectively contained in the two FPEs may also represent a spatial separation between one of the FPEs and a security feature of the banknote.

In accordance with aspects of the invention, the FPE have secure attributes that reinforces the security of the banknote and act as a security feature. Additionally, not all of the FPE may be used to protect the banknote in such an enhanced manner. That is, in embodiments, only certain secured FPEs (e.g., as described herein) may be utilized for validating the banknote. In embodiments, an ATM (or reader) at any shop or location, for example, will recognize the existing security features encountered in a normal banknote (e.g., colorshifting properties, magnetic properties, or luminescence properties), and additionally, the validation of the genuine and secure FPE in order to ascertain the validity of the banknote. In accordance with aspects of the invention, the existence of interrelated feature between the common and existing banknote security features increases the strength and robustness against forgery or diversion or counterfeit.

In further embodiments, the FPE interrelation with one exemplary embodiment utilizes a table of concordance. The table of concordance links the various possible attributes of the security features of the banknote (e.g., colorshifting properties, magnetic properties, luminescence, etc.) as various specific values (e.g., "A," "B," "C," etc.). The FPE is then interrelated with the attributes of the banknote using the appropriate specific values (e.g., "A," "B," "C," etc.) from the table of concordance. That is, the FPE may indicate a code "A, C" but does not actually identify the attributes of the banknote. By using the table of concordance to interrelate (or link) the attributes of the banknote to the FPE, the FPE itself does not reveal the actual attributes of the banknote. This prevents, for example, a hacking of the FPE to identify the attributes of the banknote. In such a manner, the FPE reflects the properties of the banknote without revealing the properties of the banknote.

As exemplified above, in accordance with aspects of embodiments of the disclosure, properties of the different security features and the FPE may be linked to provide a more secure and robust banknote.

In accordance with aspects of the disclosure, capabilities provided by the FPE included in the banknote, in addition to providing enhanced security for the banknote, for example as described above, also provide increased capabilities for the banknote. For example, in accordance with embodiments of the disclosure, the banknote has extended capabilities, mixing functionalities using one or more FPEs, such as near-field communication (NFC) devices, displays, etc., with the banknote exchange value itself. In embodiments, these increased capabilities may include increased security features, and/or additional communication features, amongst other contemplated capabilities.

For example, in embodiments, the FPE may include real-time sensing capability and/or near-field communication (NFC) functionality. The NFC functionality of the PFE of the banknote enables communication, for example, with a mobile phone, an ATM, a memory, a database, a bank account, etc. For example, the NFC FPE may be operable to communicate with scanners and/or a mobile phone to certify a transaction, and/or record a history of the transaction. In embodiments, the FPE may provide an encrypted electronic signal acting as a signature to allow its recognition as a valid banknote. For example, the banknote has an encrypted signature stored in the memory of the FPE when the banknote is produced. In accordance with embodiments of the disclosure, the FPE is readable when properly decrypted by a specific reader (e.g., a specific ATM).

FPEs can also be sensors that alert to the banknote condition. The FPE may contain (or encode) a unique ID in addition to the sensor data, such that it is possible to log the alert, e.g., in a cloud-based application for further analysis.

In embodiments, the FPE may be a display in connection with one or more other FPEs present in the banknote. The one or more FPEs may be configured to interact, for example, with a computer and/or a mobile phone, and banknote account of the user's bank, in order to transfer value to the FPE, or immediate debit note like a credit card. For example, the FPE may be a volatile memory device configured to store a money value for the banknote, which may be rechargeable.

FPEs which are present when they are in the form of sensor can be connected with communication FPE present in there and when an attempt of photocopying the banknote occurs (because the sensors capture it) warning on central banknote can be activated.

In accordance with embodiments of the disclosure, the banknote has extended capabilities, mixing functionalities using one or more FPEs, such as NFC, display, etc. (sometimes used with credit cards), with the banknote exchange value itself.

In further embodiments, in which an FPE is operable to store (e.g., in an encrypted manner) an identity (e.g., a fingerprint identity) including one or more physical attributes (e.g., of one or more banknote security features) of the banknote in a memory, if part of banknote paper is destroyed, the remaining information on the banknote and/or the banknote's fingerprint identity stored in the FPE attest to the banknote's value and authenticity. This information may be used to validate the banknote. In accordance with aspects of embodiments of the invention, even if part of banknote paper is destroyed, the banknote maintains its exchange value.

In accordance with embodiments of the disclosure, the FPE of the banknote is operable to communicate the value, for example, of the invoices paid during each day and the amounts thereof. The FPE of the banknote may also be operable to communicate the usage of the banknote in a transaction. With embodiments of the disclosure, the FPE (or another FPE) may be operable to detect location of FPE of the banknote (e.g., using a GPS system). In embodiments, this information may be used as statistical data to, for example: estimate how much money should be printed; habits of the customers; and travel paths of the respective banknotes through their distribution and circulation.

If a banknote having added FPE features is stolen, the owner, for example, using a mobile phone already containing the data related to the banknote (e.g., in a storage device) can send a communication to (e.g., all banks around the world), identifying the banknote as stolen, to be sure that the banknote is identified as stolen and/or is no longer valid. In other embodiments, the FPE may be operable to send a signal to the owner's mobile device when a banknote belonging to the owner is used. Thus, if the banknote is stolen, when the thief attempts to use the stolen banknote, the owner is notified, and can contact the police. The embedded FPE may also provide traceability capabilities for the banknote, so that, for example, a location of the stolen banknote can be determined.

In accordance with additional aspects of the disclosure, a universal banknote is provided with built-in currency conversion capabilities. That is, in embodiments, the currency value is also provided by the FPE, and the FPE may be interactive allowing conversion of the banknote, for example, from Euros to dollars, to pounds, etc. Thus, embodiments of the disclosure provide a further advantage, in that the banknote owner no longer needs to physically convert their currency upon entering or leaving jurisdictions, and no longer needs to take currency from another country.

In embodiments, the FPE can also provide encoded audio messages interacting with an ATM or specific dedicated device, for example, which will enhance the security of the banknote against forgery.

In some embodiments, the banknote includes a flexible thin battery. In embodiments, the banknote may have one or more active PFEs to provide added capabilities allowing interaction with its environment. Active PFEs may require a power source. In embodiments, flexible printed electronics may be embedded within the banknote with a sufficient power supply. In embodiments, the power supply may be a battery, such as a flexible battery (e.g., graphene flexible sheet having battery capabilities). In embodiments, the power supply may be photovoltaic cells acting as a battery. Flexible, rechargeable batteries, e.g., ultrathin zinc-polymer batteries can be printed on commonly used industrial screen printers.

In accordance with aspects of embodiments of the disclosure, the FPE batteries have a small size and flexibility, and can deliver enough current, for example, for low-power wireless communications sensors. In embodiments, the banknote may include one or more flexible electronic slots (e.g., an electric socket) for connection to the battery for recharging. In further embodiments, the battery may be rechargeable using magnetic induction (e.g., without a physical connection to a power source).

As noted above, the FPE may include one or more marker materials or taggants, for example, contained in one or more layers of the FPE. In embodiments, the markers may include one or more up-converter compounds, e.g., UV to UV or IR to IR inorganic compounds, UV to Visible, or IR to visible inorganic or organic compounds, and/or SERs compounds. Additional suitable marking compounds (e.g., particles, flakes) for marking one or more layers of the FPE are listed in US 2013/256415, the content of which is hereby expressly incorporated herein by reference, in its entirety.

By mixing different compounds from above cited group containing plurality of different combinations of markers are created that will render each FPE unique. When this unique FPE is inserted in (or arranged on) the banknote, the FPE and the banknote will be hard to forge.

Embodiments of the invention are also directed to a marked FPE, which may be inserted in (or arranged on) the banknote, or another substrate.

The detectable parameter in the FPE can be based upon luminescence by incorporating a luminescent material in any of the layers of the FPE. Preferably, the luminescent material is included in at least the one additional layer or only in the additional layer. The luminescent material can comprise one or more lanthanide compounds (having or not specific decay-time properties). The luminescent material can also comprise at least one complex of a lanthanide and a β-diketo compound. The luminescent material can be a fluorescent or phosphorescent material which emits/reflects the light is a certain range of wavelength. This has a double advantage as the fluorescent or phosphorescent material can be part of the coding, but also the emitted light can back light the detectable materials disposed in the layer above and will render the detectable materials easier to be observed.

Also, the layers, preferably the at least one additional layer or only the additional layer, can contain salts and/or complexes of rare earth metals (scandium, yttrium and the lanthanides such as Ce, Pr, Nd, Sm, Eu, Gd, Tb, Dy, Ho, Er, Tm, and Yb) and the actinides. Specific and non-limiting examples of corresponding materials include chelates of at least one of europium, ytterbium, and terbium with at least one of dipicolinic acid, 4-hydroxy-2,6-pyridinedicarboxylic acid, 4-amino-2,6-pyridinedicarboxylic acid, 4-ethoxy-2,6-pyridinedicarboxylic acid, 4-isopropoxy-2,6-pyridinedicarboxylic acid, and 4-methoxy-2,6-pyridinedicarboxylic acid. Non-limiting examples of pigments that can be used in the present invention include those disclosed in WO 2008/000755 A1, the entire disclosure of which is incorporated by reference herein.

Moreover, pigments can be those as disclosed in US 2010/0307376 A1, which is incorporated by reference herein in its entirety, such as, without limitation, at least one luminescent lanthanide complex of the formula:

$$M_3[Ln(A)_3]$$

wherein M is chosen from the alkali cations $Li^+$, $Na^+$, $K^+$, $Rb^+$ and $Cs^+$ and mixtures thereof;

wherein Ln is chosen from the trivalent rare-earth cations of Ce, Pr, Nd, Sm, Eu, Gd, Tb, Dy, Ho, Er, Tm, and Yb and mixtures thereof;

and wherein A is a dinegatively charged, tridentate 5- or 6-membered heteroaryl ligand, such as, wherein the dinegatively charged, tridentate 5- or 6-membered heteroaryl ligand A is selected form pyridine, imidazole, triazole, pyrazole, pyrazine, bearing at least one carboxylic group, and preferably ligand A is dipicolinic acid, 4-hydroxypyridine-2,6-dicarboxylic acid, 4-amino-2, 6-pyridinecarboxylic acid, 4-ethoxypyridine-2,6-dicarboxylic acid, 4-isopropoxypyridine-2,6-dicarboxylic acid and/or 4-methoxypyridine-2,6-dicarboxylic acid and/or Ln is chosen from the trivalent ions of Europium ($Eu^{3+}$) and/or Terbium ($Tb^{3+}$). Moreover, the 5 to 6 membered heteroaryl bearing at least one carboxylic group can be further substituted by a group hydroxyl, amino, a $C_1$-$C_6$-alkoxy, such as a methoxy, ethoxy, isopropoxy, etc. group or a $C_1$-$C_6$-alkyl, such as a methyl, ethyl, isopropyl, etc. group.

Non-limiting examples of IR absorber compounds for use in the present invention include those disclosed in WO2007/060133, the entire disclosure of which is incorporated by reference herein. Non-limiting examples of specific materials include copper(II) fluoride ($CuF_2$), copper hydroxyfluoride (CuFOH), copper hydroxide ($Cu(OH)_2$), copper phosphate hydrate ($Cu_3(PO_4)_2*2H_2O$), anhydrous copper phosphate ($Cu_3(PO_4)_2$), basic copper(II) phosphates (e.g. $Cu_2PO_4(OH)$, "Libethenite" whose formula is sometimes written as $Cu_3(PO_4)$ $2*Cu(OH)_2$; $Cu_3(PO_4)(OH)_3$, "Cornetite", $Cu_5(PO_4)_3(OH)_4$, "Pseudomalachite", $CuAl_6(PO_4)_4(OH)_8.5H_2O$ "Turquoise", etc.), copper (II) pyrophosphate ($Cu_2(P_2O_7)*3H_2O$), anhydrous copper(II) pyrophosphate ($Cu_2$ $(P_2O_7)$), copper(II) metaphosphate ($Cu(PO_3)_2$, more correctly written as $Cu_3(P_3O_9)_2$), iron(II) fluoride ($FeF_2*4H_2O$), anhydrous iron(II) fluoride ($FeF_2$), iron(II) phosphate ($Fe_3(PO_4)_2*8H_2O$, "Vivianite"), lithium iron(II) phosphate ($LiFePO_4$, "Triphylite"), sodium iron(II) phosphate ($NaFePO_4$, "Maricite"), iron(II) silicates ($Fe_2SiO_4$, "Fayalite"; $FexMg_2{\times}SiO_4$, "Olivine"), iron(II) carbonate ($FeCO_3$, "Ankerite", "Siderite"); nickel(II) phosphate ($Ni_3(PO_4)_2*8H_2O$), and titanium(III) metaphosphate ($Ti(P_3O_9)$). Moreover, a crystalline IR absorber may also be a mixed ionic compound, i.e., where two or more cations are participating in the crystal structure, as e.g. in $Ca_2Fe(PO_4)_2*4H_2O$, "Anapaite". Similarly, two or more anions can participate in the structure as in the mentioned basic copper phosphates, where $OH^-$ is the second anion, or even both together, as in magnesium iron phosphate fluoride, $MgFe(PO_4)F$, "Wagnerite". Additional non-limiting examples of materials for use in the present invention are disclosed in WO 2008/128714 A1, the entire disclosure of which is incorporated by reference herein.

Luminescent compounds in pigment form have been widely used in inks and other preparations (see U.S. Pat. No. 6,565,770, WO08033059, WO08092522, the entire disclosures of which are incorporated by reference herein). Examples of luminescent pigments can be found in certain classes of inorganic compounds, such as the sulphides, oxysulphides, phosphates, vanadates, garnets, spinels, etc. of nonluminescent cations, doped with at least one luminescent cation chosen from the transition-metal or the rare-earth ions.

Suitable luminescent compounds that could be incorporated in the luminescent layer according to the present invention can be found in US 2010/0307376 which relates to rare-earth metal complexes, the entire disclosure of which is incorporated by reference herein. The rare-earth metal complexes are chosen from the luminescent lanthanide complexes of trivalent rare-earth ions with three dinegatively charged, tridentate 5- or 6-membered heteroaryl ligands. The luminescent ink may comprise a stable, water-soluble tris-complex of a trivalent rare-earth cation with an atomic number between 58 and 70, such as, for example: Pr, Nd, Sm, Eu, Gd, Tb, Dy, Ho, Er, Tm, Yb and the mixtures thereof, with a tridentate, dinegatively charged heteroaryl ligand that absorb in the ultraviolet and/or the blue region of the electromagnetic spectrum. The luminescent emission in these lanthanide complexes is due to inner f-shell transitions such as: 5D0→7F1 and 5D0→7F2 for $Eu^{3+}$.

The corresponding luminescent lanthanide complex is of the formula:

$$M_3[Ln(A)_3]$$

wherein M is chosen from the alkali cations $Li^+$, $Na^+$, $K^+$, $Rb^+$ and $Cs^+$ and the mixtures thereof;

wherein Ln is chosen from the trivalent rare-earth cations of Ce, Pr, Nd, Sm, Eu, Gd, Tb, Dy, Ho, Er, Tm, and Yb; and wherein A is a dinegatively charged, tridentate 5- or 6-membered heteroaryl ligand, such as the dipicolinate anion, in which the complex has an exact 1:3 (Ln:A) stoichiometry and the dinegatively charged, tridentate 5- or 6-membered heteroaryl ligand A is selected from the group consisting of pyridine, imidazole, triazole, pyrazole, pyrazine bearing at least one carboxylic acid group. The 5 to 6 membered heteroaryl of the present invention bearing at least one carboxylic group can be further substituted by a group hydroxyl, amino, a C1-C6-alkoxy, such as a methoxy, ethoxy, isopropoxy, etc. group or a C1-C6-alkyl, such as a methyl, ethyl, isopropyl, etc. group.

As described in US 2010/0307376, the entire disclosure of which has been incorporated by reference herein, a particular process for imprinting secure document with luminescent compounds, in particular luminescent rare-earth metal complexes, is inkjet printing, and more particularly thermal inkjet printing.

Other suitable luminescent compounds which could be incorporated in the luminescent layer according to the present invention are described in US2011/0293899, the entire disclosure of which is incorporated by reference herein. As described in US 2011/0293899, a class of compounds that is suitable for use in, e.g., printing inks for marking purposes are perylene dyes, including perylene dyes with increased solubility. The parent compound perylene displays blue fluorescence and there are many derivatives of perylene which are known and may theoretically be employed as colorants in compositions for marking such as printing inks and the like. Quaterrylene, terrylene derivatives and/or a colored material, such as riboflavine or flavoinoids, which have also the advantages to be non-toxic, are also suitable luminescent compounds which can be used in the context of embodiments of the present invention.

In embodiments, the multilayer structure of an FPE may include one or more luminescent layers, as described above and each layer may additionally contain one or more luminescent compounds with different chemical and/or physical properties. Above cited examples of luminescent compounds are non-limiting examples in the context of the present disclosure. In embodiments, the luminescent layer containing the luminescent compounds used in the context of the present invention could be a partially opaque layer or an opaque layer.

With additional contemplated embodiments, the luminescent compounds, when incorporated in a coating material, such as a resin or ink, can be deposited on a FPE substrate in a random distribution by a suitable technique, such as a printing technique, such as inkjet printing or spraying techniques. This makes possible the creation of a unique code which can be based on, e.g., the random distribution of the flakes and/or different sizes of flakes.

The method can include marking an FPE, wherein the method comprises providing the substrate with a marking comprising a plurality of coding flakes; reading deterministic data and/or non-deterministic data, such as non-deterministic data representative of at least distribution of the plurality of coding flakes in the marking; and recording and storing in a computer database the deterministic and/or non-deterministic data, such as non-deterministic data representative of at least distribution of the plurality of coding flakes in the marking.

The method can also include identifying and/or authenticating a substrate, article of value or item, wherein the method comprises reading deterministic data and/or non-deterministic data of a marking associated with the substrate of the FPE including a plurality of coding flakes; and comparing using a database through a computer the read data with stored data of the deterministic and/or non-deterministic data, such as non-deterministic data representative of at least distribution of the plurality of coding flakes in the marking.

The non-deterministic data can comprise the distribution of flakes or the plurality of flakes within the marking. Moreover, the non-deterministic property can be random sizes of flakes in one or more markings. A marking in the FPE provides the FPE (and the banknote) with a unique optical signature, detectable and distinguishable through detectable parameters.

As disclosed in US 2010/200649, the entire disclosure of which is incorporated by reference herein in its entirety, the method of marking and identifying or authenticating an item can comprise the steps of a) providing an item with a random distribution of particles, (the particles being chosen from any embodiments of the flakes as disclosed herein); b) recording and storing, at a first point in time, data representative of the random distribution of flakes, using a reading device comprising illumination elements and optical detectors; c) identifying or authenticating the marked item at a later point in time using a reading device as in step b) and the stored data representative of the random distribution of particles. In embodiments, the reading devices of step b) and c), while they can be the same device, need not to be the same device, nor of the same type of device. In accordance with aspects of embodiments of the present invention, the method can use CLCP flakes that reflect a circular polarized light component, preferably in at least one spectral area chosen from the ultraviolet, the visible, and the infrared electromagnetic spectrum, i.e., between approximately 300 nm and 2500 nm wavelength.

The term "reading device" designates a device which is capable of identifying or authenticating a document (e.g., banknote) or item (e.g., FPE) marked as disclosed herein. In addition to this, the reading device may have other capabilities, such as that of reading barcodes, taking images, etc. The reading device may in particular be a modified barcode reader, camera mobile phone, an electronic tablet or pad, an optical scanner, etc. The reading can be performed with a reading device comprising at least illumination elements and optical detection elements, and can include magnetic properties detection elements depending upon parameters to be determined. The device can contain all the elements able to capture all the information and/or there can be multiple devices able to capture only or more properties from one to another, and all collected information will be after a post treatment linked together to generated the code.

As will be appreciated by the man skilled in the art, aspects of the present disclosure may be embodied as a system, a method or a computer program product. Accordingly, embodiments of the present invention may take the form of an entirely hardware embodiment, an entirely software (excluding the transducers and A/D converters) embodiment (including firmware, resident software, microcode, etc.) or an embodiment combining software and hardware aspects that may all generally be referred to herein as a "circuit," "module" or "system." Furthermore, aspects of the present disclosure may take the form of a computer program product embodied in any tangible medium of expression having computer-usable program code embodied in the medium.

Any combination of one or more computer usable or computer readable medium(s) may be utilized. The computer-usable or computer-readable medium may be, for example but not limited to, an electronic, magnetic, optical, electromagnetic, infrared, or semiconductor system, apparatus, device, or propagation medium. More specific examples (a non-exhaustive list) of the computer-readable medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CDROM), an optical storage device, a transmission media such as those supporting the Internet or an intranet, a magnetic storage device, a usb key, a certificate, a perforated card, and/or a mobile phone.

In the context of this document, a computer-usable or computer-readable medium may be any medium that can contain, store, communicate, propagate, or transport the program for use by or in connection with the instruction execution system, apparatus, or device. The computer-usable medium may include a propagated data signal with the computer-usable program code embodied therewith, either in baseband or as part of a carrier wave. The computer usable program code may be transmitted using any appropriate medium, including but not limited to wireless, wireline, optical fiber cable, RF, etc.

Computer program code for carrying out operations of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network. This may include, for example, a local area network (LAN) or a wide area network (WAN), or the connection may be made to an external computer (for example, through the Internet using an Internet Service Provider). Additionally, in embodiments, the present invention may be embodied in a field programmable gate array (FPGA).

FIG. 1 is an exemplary system for use in accordance with the embodiments described herein. The system 100 is generally shown and may include a computer system 102, which is generally indicated. The computer system 102 may operate as a standalone device or may be connected to other systems or peripheral devices. For example, the computer system 102 may include, or be included within, any one or more computers, servers, systems, communication networks or cloud environment. The computer system 102 may operate in the capacity of a server in a network environment, or in the capacity of a client user computer in the network environment. The computer system 102, or portions thereof, may be implemented as, or incorporated into, various devices, such as a personal computer, a tablet computer, a set-top box, a personal digital assistant, a mobile device, a palmtop computer, a laptop computer, a desktop computer, a communications device, a wireless telephone, a personal trusted device, a web appliance, or any other machine capable of executing a set of instructions (sequential or otherwise) that specify actions to be taken by that device. Further, while a single computer system 102 is illustrated, additional embodiments may include any collection of systems or sub-systems that individually or jointly execute instructions or perform functions.

As illustrated in FIG. 1, the computer system 102 may include at least one processor 104, such as, for example, a central processing unit, a graphics processing unit, or both. The computer system 102 may also include a computer memory 106. The computer memory 106 may include a static memory, a dynamic memory, or both. The computer memory 106 may additionally or alternatively include a hard disk, random access memory, a cache, or any combination thereof. Of course, those skilled in the art appreciate that the computer memory 106 may comprise any combination of known memories or a single storage.

As shown in FIG. 1, the computer system 102 may include a computer display 108, such as a liquid crystal display, an organic light emitting diode, a flat panel display, a solid state display, a cathode ray tube, a plasma display, or any other known display. The computer system 102 may include at least one computer input device 110, such as a keyboard, a remote control device having a wireless keypad, a microphone coupled to a speech recognition engine, a camera such as a video camera or still camera, a cursor control device, or any combination thereof. Those skilled in the art appreciate that various embodiments of the computer system 102 may include multiple input devices 110. Moreover, those skilled in the art further appreciate that the above-listed, exemplary input devices 110 are not meant to be exhaustive and that the computer system 102 may include any additional, or alternative, input devices 110.

The computer system 102 may also include a medium reader 112 and a network interface 114. Furthermore, the computer system 102 may include any additional devices, components, parts, peripherals, hardware, software or any combination thereof which are commonly known and understood as being included with or within a computer system, such as, but not limited to, an output device 116. The output device 116 may be, but is not limited to, a speaker, an audio out, a video out, a remote control output, or any combination thereof. Additionally, as shown in FIG. 1, the computer system 102 may also include a reading device 130 for reading one or more types of security features on a banknote. As also shown in FIG. 1, the computer system 102 may also include one or more FPE reading/communicating devices 140 for reading and/or communicating with an FPE (e.g., a NFC FPE or an FPE containing encoded information.

Each of the components of the computer system 102 may be interconnected and communicate via a bus 118. As shown in FIG. 1, the components may each be interconnected and communicate via an internal bus. However, those skilled in the art appreciate that any of the components may also be connected via an expansion bus. Moreover, the bus 118 may enable communication via any standard or other specification commonly known and understood such as, but not limited to, peripheral component interconnect, peripheral component interconnect express, parallel advanced technology attachment, serial advanced technology attachment, etc.

Figure 3:
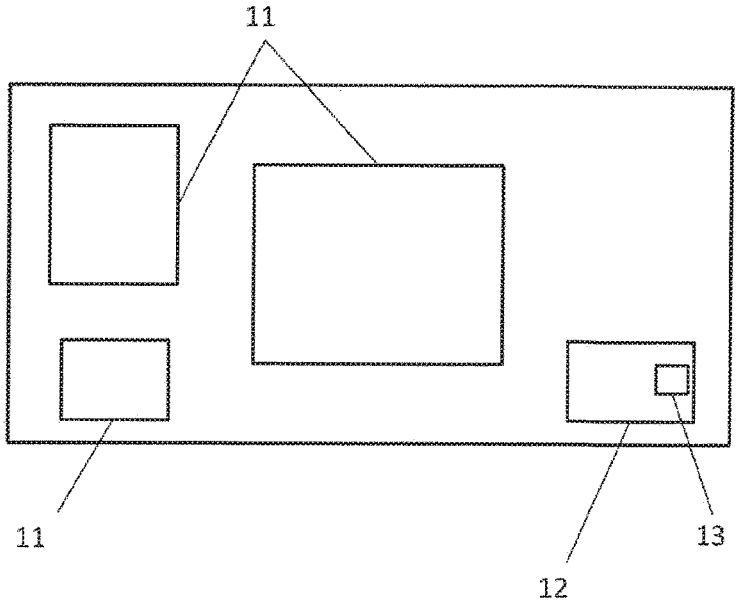
FIG. 3 schematically depicts a banknote in accordance with embodiments of the disclosure.

The computer system 102 may be in communication with one or more additional computer devices 120 via a network 122. The network 122 may be, but is not limited to, a local area network, a wide area network, the Internet, a telephony network, or any other network commonly known and understood in the art. The network 122 is shown in FIG. 3 as a wireless network. However, those skilled in the art appreciate that the network 122 may also be a wired network.

The additional computer device 120 is shown in FIG. 1 as a personal computer. However, those skilled in the art appreciate that, in alternative embodiments of the present application, the device 120 may be a laptop computer, a tablet PC, a personal digital assistant, a mobile device, a palmtop computer, a desktop computer, a communications device, a wireless telephone, a personal trusted device, a web appliance, or any other device that is capable of executing a set of instructions, sequential or otherwise, that specify actions to be taken by that device. Of course, those skilled in the art appreciate that the above-listed devices are merely exemplary devices and that the device 120 may be any additional device or apparatus commonly known and understood in the art without departing from the scope of the present application. Furthermore, those skilled in the art similarly understand that the device may be any combination of devices and apparatuses.

Of course, those skilled in the art appreciate that the above-listed components of the computer system 102 are merely meant to be exemplary and are not intended to be exhaustive and/or inclusive. Furthermore, the examples of the components listed above are also meant to be exemplary and similarly are not meant to be exhaustive and/or inclusive.

FIG. 3 schematically depicts an exemplary banknote in accordance with embodiments of the disclosure. As shown in FIG. 3, the banknote includes one or more security features 11. In embodiments, the one or more security features may include, for example, a serial number; a printed pattern, design or code made of a security ink; a intaglio printed pattern or design; a security thread or stripe; a window; a fibers; planchettes; a foil; a decal; a hologram; microprintings; a 3-D security ribbon; and a watermark. The banknote additionally includes one or more FPEs 12. In embodiments, the one or more FPEs 12 may be organic thin film transistors (OTFTs) or organic electronics, which can be produced by ink printing techniques. In some embodiments, the FPE element comprises at least one of an RFID, a sensor; a transistor, a flexible displays (e.g., OLED thin display), a flexible battery, an electronic chip, a memory, a flexible near field communication (NFC) device, and a flexible communication device, intelligent tags, large area sensors, smart labels, flexible memory, and/or integrated circuits. As shown in FIG. 3, the FPE 12 may include one or more detectable properties 13 (e.g., luminescence decay of particles), e.g., embedded in a layer of the FPE 12. In accordance with aspects of the disclosure, at least one of the security features 11 is interrelated with at least one FPE 12.

Figure 4:
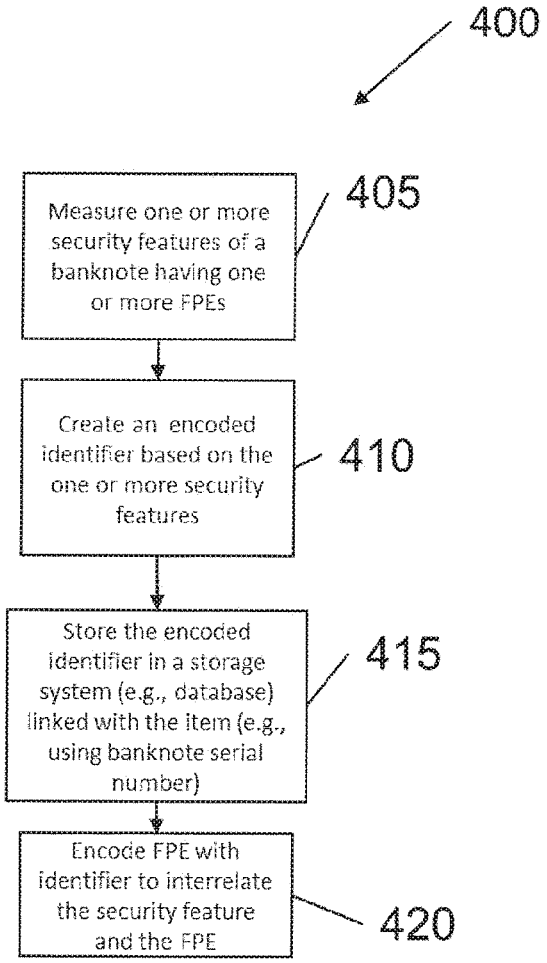
FIGS. 4 and 5 show exemplary flows for performing aspects of embodiments of the present disclosure.
Figure 5:
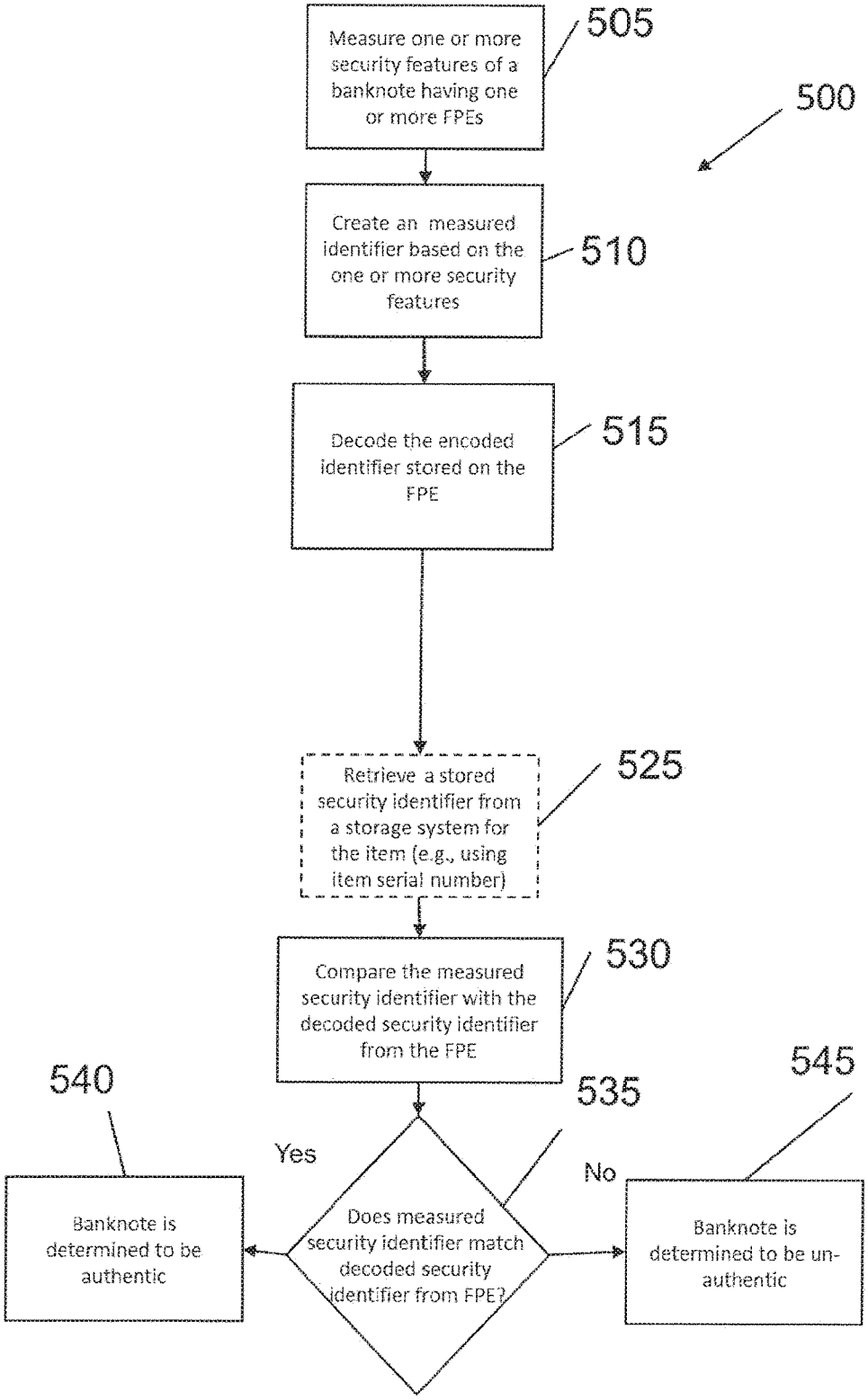

FIGS. 4 and 5 show exemplary flows for performing aspects of embodiments of the present disclosure. The steps of FIGS. 4 and 5 may be implemented in the environment of FIG. 1, for example. The flow diagrams may equally represent high-level block diagrams of embodiments of the disclosure. The flowchart and/or block diagrams in FIGS. 4 and 5 illustrate the architecture, functionality, and operation of possible implementations of systems, methods and computer program products according to various embodiments of the present disclosure. In this regard, each block in the flowcharts or block diagrams may represent a module, segment, or portion of code, which comprises one or more executable instructions for implementing the specified logical function(s). It should also be noted that, in some alternative implementations, the functions noted in the blocks may occur out of the order noted in the figure. For example, two blocks shown in succession may, in fact, be executed substantially concurrently, or the blocks may sometimes be executed in the reverse order, depending upon the functionality involved. Each block of the flowcharts, and combinations of the flowchart illustrations can be implemented by special purpose hardware-based systems that perform the specified functions or acts, or combinations of special purpose hardware and computer instructions and/or software, as described above. Moreover, the steps of the flow diagrams may be implemented and executed from either a server, in a client server relationship, or they may run on a user workstation with operative information conveyed to the user workstation. In an embodiment, the software elements include firmware, resident software, microcode, etc.

Furthermore, the invention can take the form of a computer program product accessible from a computer-usable or computer-readable medium providing program code for use by or in connection with a computer or any instruction execution system. The software and/or computer program product can be implemented in the environment of FIG. 1. For the purposes of this description, a computer-usable or computer readable medium can be any apparatus that can contain, store, communicate, propagate, or transport the program for use by or in connection with the instruction execution system, apparatus, or device. The medium can be an electronic, magnetic, optical, electromagnetic, infrared, or semiconductor system (or apparatus or device) or a propagation medium. Examples of a computer-readable storage medium include a semiconductor or solid state memory, magnetic tape, a removable computer diskette, a random access memory (RAM), a read-only memory (ROM), a rigid magnetic disk and an optical disk. Current examples of optical disks include compact disk-read only memory (CD-ROM), compact disc-read/write (CD-R/W) and DVD.

FIG. 4 illustrates an exemplary flow 400 for creating an interrelationship between at least one FPE and one or more security features of a banknote in accordance with aspects of embodiments of the disclosure.

As shown in FIG. 4, at step 405 a measuring tool (e.g., security feature detection device, shown in FIG. 1) is operable to detect (or capture) one or more security features of a banknote. As should be understood by the skilled man, depending on which security features are utilized, one or more different measuring tools may be used (e.g., microphones, cameras, etc.). At step 410, the system is operable to create an encoded security identifier based on the one or more security biometric features. At step 415, the system is operable to store the security identifier in a storage system (e.g., database) linked with the item (e.g., using item serial number of the item). At step 415, the system is operable to encode an FPE with the identifier to interrelate the security feature and the FPE.

FIG. 5 illustrates an exemplary flow 500 for authenticating a banknote in accordance with aspects of embodiments of the disclosure.

As shown in FIG. 5, at step 505, a measuring tool (e.g., security feature detection device, shown in FIG. 1) is operable to detect (or capture) one or more security features of a banknote. At step 510, the system is operable to create a measured security feature identifier based on the one or more measured security features. At step 515, the system is operable to detect and analyze an FPE encoding a stored security feature identifier. At optional step 525, the system may retrieve a stored security identifier from a storage system for the item (e.g., using item serial number).

At step 530, the system is operable to compare the measured security identifier with the decoded security identifier from the FPE. At step 535, the system is operable to determine whether the measured security identifier matches the decoded security identifier from the FPE. If, at step 535, the system determines that the measured security identifier matches the decoded security identifier from the FPE, at step 540, the banknote is determined to be authentic. If, at step 535, the system determines that the measured security identifier does not match the decoded security identifier from the FPE, at step 545, the banknote is determined to be un-authentic.

Accordingly, the present disclosure provides various systems, servers, methods, media, and programs. Although the disclosure has been described with reference to several exemplary embodiments, it is understood that the words that have been used are words of description and illustration, rather than words of limitation. Changes may be made within the purview of the appended claims, as presently stated and as amended, without departing from the scope and spirit of the disclosure in its aspects. Although the disclosure has been described with reference to particular materials and embodiments, embodiments of the invention are not intended to be limited to the particulars disclosed; rather the invention extends to all functionally equivalent structures, methods, and uses such as are within the scope of the appended claims.

While the computer-readable medium may be described as a single medium, the term "computer-readable medium" includes a single medium or multiple media, such as a centralized or distributed database, and/or associated caches and servers that store one or more sets of instructions. The term "computer-readable medium" shall also include any medium that is capable of storing, encoding or carrying a set of instructions for execution by a processor or that cause a computer system to perform any one or more of the embodiments disclosed herein.

The computer-readable medium may comprise a non-transitory computer-readable medium or media and/or comprise a transitory computer-readable medium or media. In a particular non-limiting, exemplary embodiment, the computer-readable medium can include a solid-state memory such as a memory card or other package that houses one or more non-volatile read-only memories. Further, the computer-readable medium can be a random access memory or other volatile re-writable memory. Additionally, the computer-readable medium can include a magneto-optical or optical medium, such as a disk or tapes or other storage device to capture carrier wave signals such as a signal communicated over a transmission medium. Accordingly, the disclosure is considered to include any computer-readable medium or other equivalents and successor media, in which data or instructions may be stored.

Although the present application describes specific embodiments which may be implemented as code segments in computer-readable media, it is to be understood that dedicated hardware implementations, such as application specific integrated circuits, programmable logic arrays and other hardware devices, can be constructed to implement one or more of the embodiments described herein. Applications that may include the various embodiments set forth herein may broadly include a variety of electronic and computer systems. Accordingly, the present application may encompass software, firmware, and hardware implementations, or combinations thereof.

Although the present specification describes components and functions that may be implemented in particular embodiments with reference to particular standards and protocols, the disclosure is not limited to such standards and protocols. Such standards are periodically superseded by faster or more efficient equivalents having essentially the same functions. Accordingly, replacement standards and protocols having the same or similar functions are considered equivalents thereof.

The illustrations of the embodiments described herein are intended to provide a general understanding of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

Accordingly, the novel architecture is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

While the invention has been described with reference to specific embodiments, those skilled in the art will understand that various changes may be made and equivalents may be substituted for elements thereof without departing from the true spirit and scope of the invention. In addition, modifications may be made without departing from the essential teachings of the invention.

For example, while the instant disclosure has been explained with reference to banknotes, the present disclosure could also be utilized with other products, such as passports and other security documents, works of art, animal hides, gemstones, and/or other products that a are susceptible to copying or counterfeiting.

The invention claimed is:

1. A banknote comprising:

one or more security features, at least two flexible printed electronic (FPE) elements embedded in the banknote, an organic thin film transistor having at least one plastic layer and at least one organic layer, wherein the one or more security features comprise at least one of inorganic and fluorescent molecules within the organic thin film transistor, wherein at least one of the one or more security features and at least one of the at least two FPE elements have an interrelationship with each other, wherein a plurality of the at least two FPE elements have an interrelationship with each other, and wherein each FPE element contains one or more security features comprising a chemical key represented with a set of molecules having different absorption or emission spectra.

2. The banknote of claim 1, wherein at least one of the FPE elements is a passive electronic element or an active electronic element.

3. The banknote according to claim 1, further comprising an encrypted signature stored in a memory of an FPE when the banknote is produced, said FPE being readable when decrypted by an ATM or reader.

4. The banknote according to claim 1, wherein the interrelationship is verifiable to authenticate the banknote.

5. The banknote according to claim 1, wherein the interrelationship is between a property of a first of the one or more security features and a property of a second of the one or more security features.

6. The banknote according to claim 1, wherein at least one FPE element comprises one or more elements selected from the group consisting of RFIDs, sensors, transistors, flexible displays, flexible batteries, electronic chips, memories, flexible near field communication (NFC) devices, and flexible communication devices.

7. The banknote according to claim 6, wherein the sensor or the transistor has analysis capabilities.

8. The banknote according to claim 1, wherein the one or more security features are selected from the group consisting of serial numbers, printed patterns, designs or codes made of a security ink, intaglio printed patterns or designs, security threads or stripes, windows, fibers, planchettes, foils, decals, holograms, microprintings, fine line printing patterns, 3-D security ribbons, and watermarks.

9. The banknote according to claim 1, wherein at least one FPE element comprises one or more printed layers, wherein at least one of the one or more printed layers comprises one or more marker materials or taggants.

10. The banknote according to claim 1, including a flexible thin battery and wherein at least one of the at least two FPE elements is an active FPE powered by the flexible thin battery.

11. The banknote according to claim 1, wherein the FPE interrelation comprises a spatial relationship and/or a relative size relationship between the plurality of the at least two FPE elements.

12. The banknote according to claim 1, wherein the FPE interrelation is itself interrelated with at least one of the one or more security features or wherein the FPE interrelation is itself interrelated with the interrelationship between the one or more security features and at least one FPE.

13. A method of authenticating a banknote comprising:

detecting one or more security features of a banknote according to claim 1;

detecting at least one flexible printed electronic (FPE) element in the banknote, wherein at least one of the one or more security features and at least one FPE element have an interrelationship with each other; and verifying the interrelationship to authenticate the banknote.

14. The banknote of claim 1, comprising "n" FPE elements and "m" luminescent compounds, providing n*m potential combinations of secure FPEs dispatched in each banknote.

15. The banknote of claim 7, wherein said sensor or transistor is operable to detect at least one of a capacitance, an impedance, and a pH value of the banknote.

16. A method of making a banknote comprising:

providing a banknote comprising one or more security features, including at least two flexible printed electronic (FPE) elements in the banknote, an organic thin film transistor having at least one plastic layer and at least one organic layer, wherein the one or more security features comprise at least one of inorganic and fluorescent molecules within the organic thin film transistor, wherein at least one of the one or more security features and at least one of the at least two FPE elements have an interrelationship with each other, wherein a plurality of the at least two FPE elements have an interrelationship with each other, and each FPE element contains one or more security features comprising a chemical key represented with a set of molecules having different absorption or emission spectra.

17. The method of making a banknote of claim 16, wherein said banknote comprises "n" FPE elements and "m" luminescent compounds, providing n*m potential combinations of secure FPEs dispatched in each banknote.

* * * * *